US005186528A

United States Patent [19]

Schardt et al.

[11] Patent Number: 5,186,528

[45] Date of Patent: Feb. 16, 1993

[54] REMOVABLE ACCESS PANELS FOR ROOFTOP UNIT

[75] Inventors: David L. Schardt, Brentwood; Lois A. Luna, Murfreesboro, both of Tenn.; Ivor S. Jones, Brantford, Canada

[73] Assignee: Inter-City Products Corporation (USA), Lavergne, Tenn.

[21] Appl. No.: 677,234

[22] Filed: Mar. 29, 1991

[51] Int. Cl.[5] ..... A47B 47/00; F25D 19/00

[52] U.S. Cl. ..... 312/100; 312/265.6; 312/296

[58] Field of Search ..... 312/263, 296, 229, 100, 312/265.6, 265.5; 52/588; 62/265, 259.1; 165/75

[56] References Cited

U.S. PATENT DOCUMENTS

| | | | |
|---|---|---|---|
| 1,157,158 | 10/1915 | Harry | 52/588 X |
| 3,254,705 | 6/1966 | Worthen et al. | 165/75 X |
| 4,118,083 | 10/1978 | Lackey et al. | 312/100 |
| 4,415,023 | 11/1983 | Vandervaart | 165/122 |
| 4,442,890 | 4/1984 | Vandervaart | 165/124 |
| 4,747,505 | 5/1988 | Hansen | 220/4 |

*Primary Examiner*—Peter R. Brown
*Attorney, Agent, or Firm*—Baker & Daniels

[57] ABSTRACT

The present invention is an access panel for a roof top air conditioning unit. The access panel edges interfit with edges of the air conditioner cabinet to form a tortuous path for entry into the cabinet interior. The tortuous path inhibits air, water, and moisture penetration. Also, insulating material is trapped between the interfitting edges to further block the penetration and insulate the cabinet interior. At the top edge, a lip extends downwardly to provide a positive stop to keep the removable access panel from laterally falling.

23 Claims, 1 Drawing Sheet

REMOVABLE ACCESS PANELS FOR ROOFTOP UNIT

BACKGROUND OF THE INVENTION

1. Field of the Invention

The present invention relates to rooftop heating and air conditioning units. Specifically, the field of the invention is that of access panels for the cabinets of such rooftop units.

2. Prior Art

Rooftop heating and air conditioning unit cabinets house the compressor, the outdoor coils, and often the indoor blower. The cabinets are generally constructed from a base unit, a top unit, and a plurality of posts and panels which are fixed together between the base and top. Desirable cabinets are structurally sound and provide protection for the internal components, yet also allow access to those internal components in case that servicing may become necessary. Easy access to those components facilitates installation and servicing, which is routinely required to maintain the air conditioning unit.

Some prior art roof top units provide access by means of doors fabricated in openings in the cabinet wall. These structures require expensive manufacturing steps, and often are not easily removed for servicing. Other prior art structures use hinged doors attached over openings in the cabinet wall. While the hinges initially provide relatively easy access to the internal components, the hinges may rust due to the outdoor conditions and may be difficult to align properly.

One problem with prior art roof top units is that the portions which provide access are not well sealed. When not adequately sealed, air and moisture penetrating through the access portions interfere with the heating or cooling performance of the unit. Also, that penetrating water and moisture may enter and corrode the interior components of the unit.

What is needed is an access panel for a roof top air conditioning unit relatively inexpensive to manufacture.

Also needed is an access panel which is relatively easy to remove.

Additionally, a need exits for an access panel resistive to penetration of water and moisture.

SUMMARY OF THE INVENTION

The present invention provides access panels for roof top units which form a tortuous connection with the cabinet to deter entry of air, water, and moisture into the interior of the roof top air conditioning cabinet. Also, material is trapped between the access panel and cabinet which insulates the cabinet interior from external conditions.

The present invention is, in one form, a cabinet comprising a top, a base, support panels, a removable access panel, and an insulating buffer. The top and base have an outer edges between which are disposed a plurality of support panels. The support panels, top, and base define an interior region, and a pair of adjacent support panels have adjacent edges which define an access opening with an elongated panel flange extending from each adjacent edge. The removable side panel is disposed between the adjacent support panels and has a generally planar side wall and two extensions projecting farther than the panel flange and overlapping the panel flange to form a tortuous path. Further, an insulating buffer is trapped between the access panel extension and the panel flange for blocking air and water leakage through the tortuous path.

One object of the present invention is to provide an access panel for a roof top air conditioning unit which is relatively inexpensive to manufacture.

Another object is to provide an access panel which is relatively easy to remove.

An additional object is to provide an access panel resistive to penetration of water and moisture.

A further object is to provide an access panel which adequately insulates the cabinet interior.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
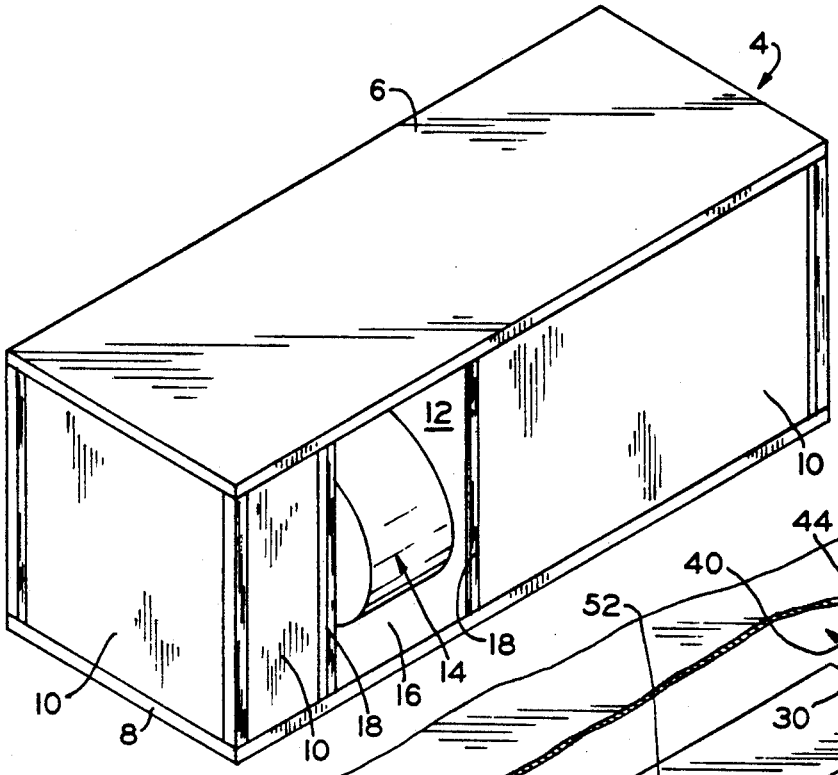
FIG. 1 is a perspective view of a roof top air conditioner unit.

Corresponding reference characters indicate corresponding parts throughout the several views. The exemplification set out herein illustrates a preferred embodiment of the invention, in one form thereof, and such exemplifications are not to be construed as limiting the scope of the invention in any manner.

DESCRIPTION OF THE PREFERRED EMBODIMENT

The present invention relates to roof top air conditioning unit 4 depicted in FIG. 1. Unit 4 has a cabinet body including top 6, base 8, and support panels 10 which define cabinet interior 12. Cabinet interior 12 houses air conditioning equipment 14 which may have separate heating and cooling sections including various well known components such as, for example, indoor and outdoor blowers (not shown), heat exchanger coils (not shown), and base pans (not shown). Access opening 16 is defined vertically between opposite edges 18 having cabinet flanges 20. As shown in FIG. 1, access opening 16 is bounded at its upper periphery by top 6, and at its lower periphery by base 8. However, an access opening could be defined by additional panels 10 extending from the upper and lower boundaries. Further, although described as separate elements, top 6, base 8, and support panels 10 may be integrally formed to define an access opening.

Figure 2:
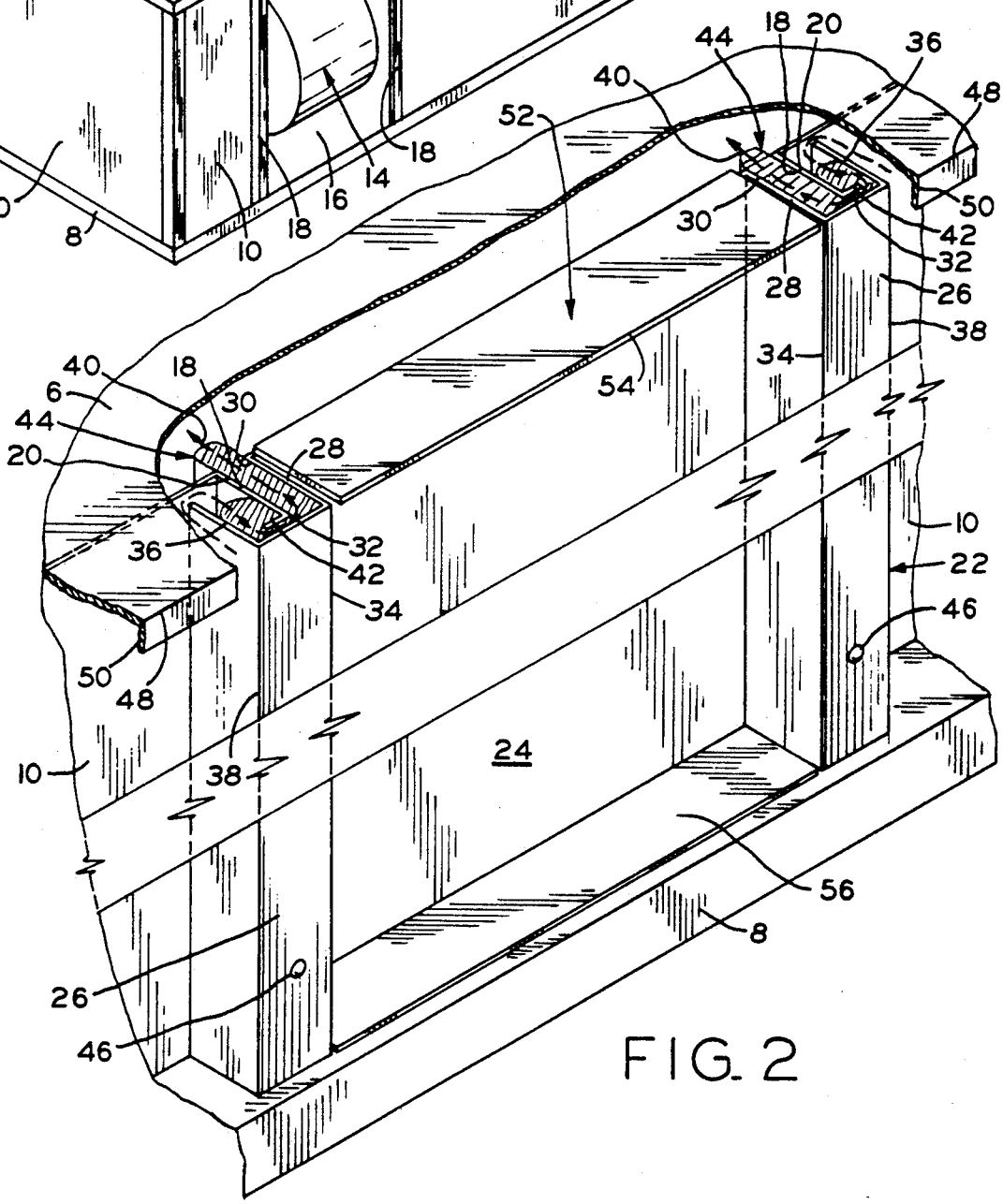
FIG. 2 is a perspective view, in partial cut-away, of the removable access panel of the present invention.

In accordance with the present invention, access panel 22 may be located over access opening 16 to prevent the entry of water, moisture, or air into interior 12 as shown in FIG. 2. Access panel 22 includes a generally flat side wall 24 and vertically disposed U-shaped extensions 26, one on each side adjacent to cabinet flanges 20. Each extension 26 includes a first portion 28 disposed generally perpendicularly from edge 30 of side wall 24. Also, second portion 32 of extension 26 is disposed generally perpendicularly from edge 34 of first portion 28, generally parallel to wall 24 but protruding in the opposite direction from first portion 28. Finally, third portion 36 is disposed generally perpendicularly from edge 38 of second portion 32, generally parallel to first portion 28 and having a slightly lesser length. Portions 28, 32, and 36 form a U-shaped structure defining a channel, with the width of second portion 32 preferably being less than that of a person's palm so that access panel 24 may be conveniently gripped by grasping surfaces of first portion 28 and third portion 36.

As shown in FIG. 2 by dotted line 40, a tortuous path is formed between the interfitting flange 20 and extension 26. Each extension 26 surrounds and overlaps its corresponding flange 20. Tortuous path 40 is defined by extension 26 and flange 20, with flange 20 also including rim 42 which extends perpendicularly from flange 20 and faces second portion 32. Tortuous path 40 inhibits the penetration of water, moisture, and air into interior 12 because fluid flow must reverse direction twice before proceeding into interior 12.

Further, in the exemplary embodiment, an insulating buffer of insulation material 44 is affixed to access panel 24 so that insulation 44 is trapped when access panel 24 is attached to vertical edges 18. Alternatively, insulation 44 may be affixed to vertical edges 18 to provide similar results. Insulation 44 restricts fluid flow through tortuous path 40, and also provides a thermally insulating layer between interior 12 and the external conditions. Flange 20 is almost as long as first portion 28 of extension 26, so that insulation material 44 which is trapped between rim 42 and portion 32 is compressed thereby increasing its inherent resistance to fluid flow. Further, insulation 44 is compressed along the line of contact between flange 20 and portion 28 as well as the line of contact between rim 42 and portion 32, which provides a greater degree of compression than a point of contact compression. The compression of insulation 44 along those lines of contact enhances the resistance to penetration of air and moisture through the connection of panel 22 and edges 18.

Access panel 24 is attached to vertical edges 18 by screws 46 which extend through portion 32 and rim 42. Alternatively, other attachment arrangements could be used, such as a friction fit, a snap fit, etc. Additionally, top edge 48 includes lip 50 which helps to secure panel 22 to cabinet 4. Upper portion 52 of access panel 22 includes protrusion 54 which is adjacent top edge 48. Lip 50 prevents upper portion 52 from moving laterally away from vertical edges 18, and also blocks direct flow of water, moisture, and air between upper portion 52 and top 6. Insulation material 44 may also be disposed between upper portion 52 and top 6 to further enhance the penetration inhibiting and insulating properties of access panel 22.

To attach access panel 22 to unit 4, first upper portion 52 is inserted underneath top 6 and within lip 50. Extensions 26 are aligned with flanges 20, and lower portion 56 is pivoted inwardly until adjacent to support panels 10. Finally, to secure access panel 22 across access opening 16, screws 46 are attached and fixedly secure extensions 26 to vertical edges 18. During attachment, access panel 22 may be conveniently handled by grasping extensions 26. To remove access panel 22 from unit 4, the above described process is reversed.

Access panel 22 may be made from a single sheet of metal which is bent or brake pressed to form the structure and shape described above. Preferably, the material of access panels 22 comprises G90 pre-painted steel, having a thickness of about 0.86 mm. Also, any suitable material may be used for insulation material 44, such as TUF-SKIN (a trademark of Johns Mansville Corporation of Denver, Colo.) insulation for an access panel to a cooling section, or foil face insulation for an access panel to a heating section. Preferably, insulation 44 has a thickness of about 12.7 mm (0.5 inches).

While this invention has been described as having a preferred design, the present invention can be further modified within tho spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cabinet for an air conditioner, said cabinet comprising:

a cabinet body defining an interior region and an access opening, said cabinet body including two opposite edges which partially define said access opening, said opposite edges including respective cabinet flanges; and a removable panel disposed in said access opening, said removable panel having a generally planar side wall and two extensions projecting farther than said cabinet flanges, said extensions being arranged to overlap and surround said cabinet flanges to form a tortuous path for blocking penetration of air and water between said removable panel and said cabinet flanges.

2. The cabinet of claim 1 wherein said cabinet body includes a top, a base, and a plurality of support panels extending between said top and said base.

3. The cabinet of claim 2 wherein said top includes a lip extending generally downward from a peripheral edge of said top, with an upper portion of said removable side panel extending vertically above said lip whereby said removable side panel is positively stopped from falling.

4. The cabinet of claim 1 wherein said removable side panel includes attaching means for securing said removable side panel to said cabinet body.

5. The cabinet of claim 1 wherein said extensions are generally U-shaped and extend adjacent to said cabinet flanges.

6. The cabinet of claim 1 further comprising insulation material disposed within said tortuous path.

7. The cabinet of claim 6 wherein said insulation material is affixed to said access panel.

8. The cabinet of claim 6 wherein said insulation material is affixed to said cabinet body.

9. The cabinet of claim 1 wherein said cabinet flange includes a rim extending generally perpendicularly from said cabinet flange.

10. A cabinet for an air conditioner, said cabinet comprising:

a cabinet body defining an interior region, said cabinet including opposite edges which partially define an access opening in said cabinet body, and respective cabinet flanges extending from each said cabinet body edge;

a removable side panel disposed between said cabinet body edges, said removable panel having edges which are adjacent to said cabinet body edges, said panel edges being arranged to overlap and surround said cabinet body edges; and buffer means trapped between said cabinet body edges and said panel edges for blocking penetration of air and water between said removable panel and said cabinet body.

11. The cabinet of claim 10 wherein said cabinet body includes a top, a base, and a plurality of support panels extending between said top and said base.

12. The cabinet of claim 11 wherein said top includes a lip extending generally downward from a peripheral edge of said top, with an upper portion of said side panel extending vertically above said lip whereby said side panel is positively stopped from falling.

13. The cabinet of claim 10 wherein said buffer means comprises insulation material.

14. The cabinet of claim 13 wherein said insulation material is affixed to said access panel.

15. The cabinet of claim 13 wherein said insulation material is affixed to said cabinet body.

16. A roof top air conditioning unit comprising:

a cabinet including a top, a base, and a plurality of side portions which define an interior region, said side portions extending between said top and said base, said cabinet defining an access opening between two of said side portions, an edge of each of said two side portions having an outwardly extending cabinet flange;

an air conditioner disposed within said cabinet interior region;

a removable panel disposed between said two side portions, said removable panel having a generally planar wall and two extensions projecting farther than said cabinet flange, said extensions being arranged to overlap and surround said cabinet flange to form a tortuous path; and buffer means trapped between said extensions and said cabinet flanges for blocking penetration of air and water through said tortuous path.

17. The roof top air conditioning unit of claim 16 wherein said panel includes attaching means for securing said removable panel to said pair of adjacent ones of said side portions.

18. The roof top air conditioning unit of claim 16 wherein said extension is generally U-shaped with a peripheral edge extending adjacently to said side portion.

19. The roof top air conditioning unit of claim 16 wherein said buffer means comprises insulation material.

20. The roof top air conditioning unit of claim 19 wherein said insulation material is affixed to said panel.

21. The roof top air conditioning unit of claim 19 wherein said insulation material is affixed to said cabinet.

22. The roof top air conditioning unit of claim 16 wherein said cabinet flange includes a rim extending generally perpendicularly from said cabinet flange.

23. The roof top air conditioning unit of claim 16 wherein said top includes a lip extending generally downward from a peripheral edge of said top, with an upper portion of said removable panel extending vertically above said lip whereby said removable panel is positively stopped from falling.

* * * * *